US011519115B2

(12) United States Patent
Massotte

(10) Patent No.: US 11,519,115 B2
(45) Date of Patent: Dec. 6, 2022

(54) HEAT DISTRIBUTION MANAGEMENT DEVICE FOR YARN TREATMENT

(71) Applicant: Superba S.A.S., Mulhouse (FR)

(72) Inventor: Philippe Massotte, Gueberschwihr (FR)

(73) Assignee: SUPERBA SAS, Mulhouse (DE)

( * ) Notice: Subject to any disclaimer, the term of this patent is extended or adjusted under 35 U.S.C. 154(b) by 564 days.

(21) Appl. No.: 16/207,960

(22) Filed: Dec. 3, 2018

(65) Prior Publication Data

US 2019/0169776 A1 Jun. 6, 2019

(30) Foreign Application Priority Data

Dec. 4, 2017 (EP) ..... 17205263

(51) Int. Cl.

| | |
|---|---|
| ***D06B 3/04*** | (2006.01) |
| ***D06C 7/00*** | (2006.01) |
| ***C21D 9/56*** | (2006.01) |
| ***D06B 23/04*** | (2006.01) |
| ***C21D 9/52*** | (2006.01) |
| ***C21D 9/68*** | (2006.01) |
| ***D02J 13/00*** | (2006.01) |

(52) U.S. Cl.

CPC ..... *D06B 3/04* (2013.01); *C21D 9/525* (2013.01); *C21D 9/56* (2013.01); *D06B 23/042* (2013.01); *D06C 7/00* (2013.01); *C21D 9/561* (2013.01); *C21D 9/68* (2013.01); *D02J 13/001* (2013.01)

(58) Field of Classification Search

CPC ..... D06B 3/04; D06B 5/06; B06B 23/042

USPC ..... 28/219; 8/149.2; 68/5, 222; 26/18.5, 26/81, 92, 106

See application file for complete search history.

(56) References Cited

U.S. PATENT DOCUMENTS

| | | | | |
|---|---|---|---|---|
| 2,777,750 A * | 1/1957 | Sprague | D06M 11/05 | 26/96 |
| 3,659,439 A * | 5/1972 | Tindall | D06B 17/005 | 68/5 D |
| 3,683,650 A * | 8/1972 | Hirschburger | D06C 7/02 | 68/5 D |
| 3,898,035 A * | 8/1975 | Tillotson | D06B 11/0026 | 28/165 |
| 3,949,577 A * | 4/1976 | Fleissner | D06B 19/0035 | 68/5 D |

(Continued)

FOREIGN PATENT DOCUMENTS

| | | |
|---|---|---|
| EP | 1942218 A2 | 7/2008 |
| FR | 1388330 A | 2/1965 |

(Continued)

OTHER PUBLICATIONS

Europe Patent Application No. 17205263.1, Search Report and Written Opinion, dated May 24, 2018.

*Primary Examiner* — Jason L Vaughan

(74) *Attorney, Agent, or Firm* — Kilpatrick Townsend & Stockton LLP

(57) ABSTRACT

The subject matter of this invention is a heat distribution management device in a treatment device of yarns in movement on a means of transport, said means of transport being able to be traversed by a flow of heat at or through the of orifices, characterized in that the device comprises at least one means of sealing by coverage of at least one part of the orifices of the means of transport, said means of sealing being independent of the means of transport.

13 Claims, 2 Drawing Sheets

(56) References Cited

U.S. PATENT DOCUMENTS

| | | | | | |
|---|---|---|---|---|---|
| 3,955,287 | A * | 5/1976 | Brock | F26B 21/02 | 34/212 |
| 3,981,163 | A * | 9/1976 | Tillotson | D06B 11/0036 | 68/28 |
| 4,169,707 | A * | 10/1979 | Gloeckler | D06B 17/005 | 68/5 D |
| 4,571,765 | A * | 2/1986 | Okada | D02J 13/001 | 68/5 E |
| 4,754,619 | A * | 7/1988 | Keith | D02J 13/001 | 68/5 E |
| 5,014,380 | A | 5/1991 | Enderlin | | |
| 5,092,139 | A * | 3/1992 | Runser | D06B 17/005 | 68/5 D |
| 5,369,968 | A * | 12/1994 | Bertoldo | D06B 19/0035 | 68/5 E |
| 7,543,463 | B2 * | 6/2009 | Rhyne | D02J 13/001 | 68/5 D |
| 8,893,359 | B2 * | 11/2014 | Brenk | D06B 23/18 | 28/220 |
| 9,951,445 | B2 * | 4/2018 | Boetsch | D02G 1/125 | |
| 10,465,313 | B2 * | 11/2019 | Beckers | D02J 13/00 | |
| 2008/0164360 | A1 | 7/2008 | Mazoyer | | |

FOREIGN PATENT DOCUMENTS

| | | | |
|---|---|---|---|
| FR | 2655064 | A1 | 5/1991 |
| WO | 198806653 | A1 | 9/1988 |

* cited by examiner

HEAT DISTRIBUTION MANAGEMENT DEVICE FOR YARN TREATMENT

CROSS-REFERENCE TO RELATED APPLICATION

This application claims priority from European Patent Application No. 17205263.1 filed Dec. 4, 2017, the contents of which are hereby incorporated by reference into this application.

FIELD OF THE INVENTION

This invention relates to the field of heat distribution management mechanisms in heat treatment devices for yarns and more specifically to the field of mechanisms for the optimization of heat distribution around the portion of yarn to be treated on the inside of a heat treatment device.

BACKGROUND OF THE INVENTION

At present, the treatment of a yarn or of a yarn bundle in a treatment device takes place through the placement of the yarn on the conveyor belt which moves inside the treatment device.

On the inside of the treatment device, the yarn or yarn bundle may be guided to switch means of transport passing from one belt to another depending on the defined path.

In the framework of heat treating, for example, by distribution of steam flows in a treatment chamber, the means of transport are realized in the form of a structure or transport device which allows a traversing by steam flows and/or by heat flows. This construction of the means of transport thereby participates in the heat treatment on each of the faces of the yarn bundle placed on the means of transport. Thus, the heat treatment is not exclusively accomplished on the sole exposed face of the yarn on the means of transport, which is to say to the detriment of the yarn face which would be in direct contact with the means of transport.

Nonetheless, this particular structure of the means of transport presents a disadvantage in the treatment of the ends of the yarn or of the yarn bundle.

Indeed, during the placement of the downstream yarn end, the surface of the means of transport is free on at least one part of its length up until the yarn or yarn bundle is placed on the whole of the length of the means of transport. Furthermore, when only a part of the length of the means of transport is covered by the yarn or yarn bundle, the part of the free means of transport then presents a structure which more readily enables the flows of heat and steam than the part of the means of transport which is covered by the yarn or yarn bundle. The flows of heat or of steam then have the tendency to firstly travel through the part of the means of transport which presents a free structure. Such a priority of placement is made to the detriment of the part of the means of transport which carries the yarn or yarn bundle and therefore to the detriment of the quality of the heat treatment of the yarns.

There is the identical problem at the upstream end of the treated yarn or yarn bundle. This problem of heat distribution in the heat treatment device therefore leads to the production of a yarn or yarn bundle having a heterogeneous quality of treatment over its whole length.

BRIEF SUMMARY OF THE INVENTION

This invention intends to overcome these disadvantages by proposing a solution which, on the one hand, allows for a yarn or yarn bundle having an identical treatment over the whole of its length and which, on the other hand, can readily be implemented in an already existing heat treatment device.

The subject matter of the invention is therefore a heat distribution management device in a treatment device of yarns in movement on a means of transport, the means of transport being able to be traversed by a flow of heat at or through the orifices, characterized in that the device comprises at least one means of sealing or sealing device by coverage of at least one part of the orifices of the means of transport, this means of sealing being independent of the means of transport.

The invention furthermore relates to implementation process of at least one heat distribution management device according to the invention, characterized in that the process comprises:

- a stage involving placement of the heat distribution management device on a means of transport at the inlet opening of the treatment device of the yarns,
- a stage involving distribution of the management device on at least one part of the width of the means of transport.

The invention furthermore relates to a mechanism for the recovery of a heat distribution management device according to the invention, characterized in that said recovery mechanism, capable of being positioned at the outlet of the treatment device of the yarns, comprises at least:

- one fastening interface to at least one end of the management device,
- one pivot axis which the fastening interface is mounted on,
- one device for coiling around the pivot axis,
- one device for adjustment of the coiling speed on the basis of the speed of movement of at least one means of transport of the treatment device of the yarns.

BRIEF DESCRIPTION OF THE DRAWINGS

The invention will be better understood, thanks to the description here below, which refers to a preferred embodiment, which is given as a non-limiting example, and which is explained with reference to the appended schematic drawings, in which.

DETAILED DESCRIPTION

Figure 1:
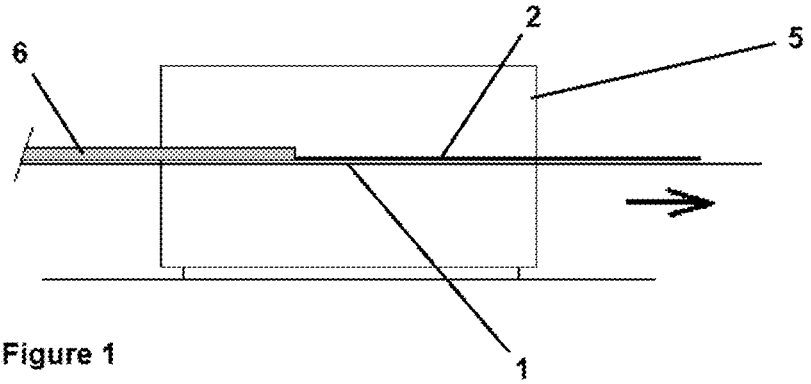
FIG. 1 is a schematic representation of a variant of the device of the invention downstream of the yarn to be treated.
Figure 2:
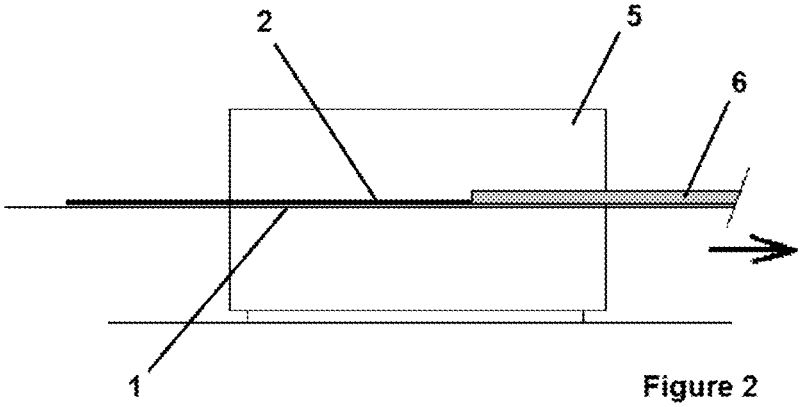
FIG. 2 is a schematic representation of a variant of the device of the invention upstream of the yarn to be treated.
Figures 3, 3B:
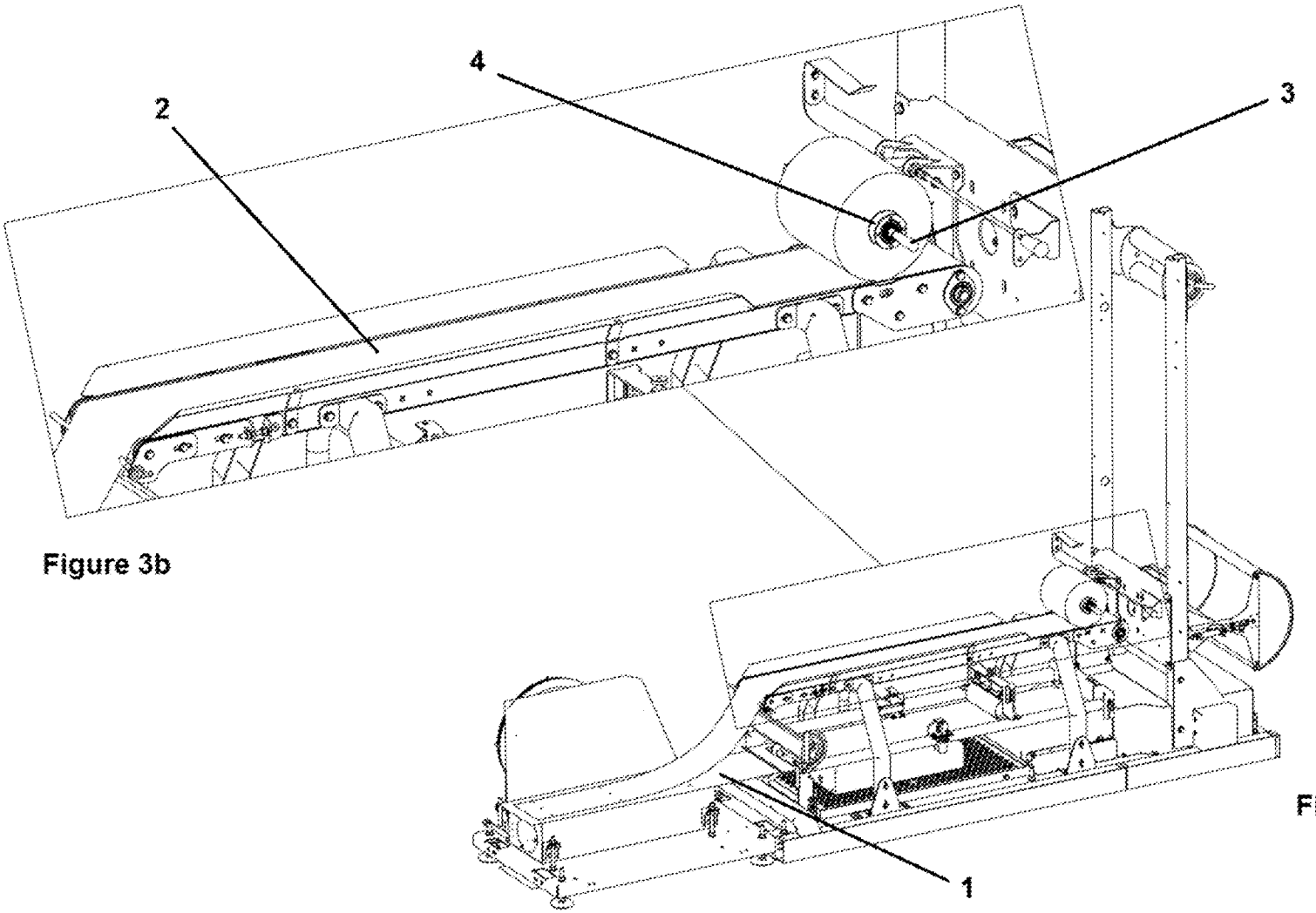
FIGS. 3 and 3*b* are schematic and detailed representations of an example of a mechanism for the recovery of a heat distribution management device according to the invention.

In this document, the terms "downstream" and "upstream" define positions in relation to the direction of movement of a yarn being treated and/or of a yarn on a means of transport 1 of the treatment device 5.

This invention relates to a heat distribution management device in a treatment device 5 of yarns 6 in movement on a means of transport 1, said means of transport 1 being able to be traversed by a flow of heat at or through the orifices, characterized in that the device comprises at least one means of sealing 2 by coverage of at least one part of the orifices of the means of transport 1, this means of sealing 2 being independent of the means of transport.

The means of sealing 2 of the device is intended to take the place of a yarn or a yarn bundle 6, upstream and/or downstream of the yarn or yarn bundle 6 that is to be treated, during the treatment of the yarn 6 placed on the means of transport 1 in the treatment device 5 of the yarns 6. This means of sealing 2 thereby allows the coverage of the orifices of the means of transport 1 in a manner similar to that of an equivalent yarn or yarn bundle 5 which would be positioned upstream or downstream of the yarn or yarn bundle 5 to be treated. Furthermore, the movement of the flows of heat or of steam through the part of the means of transport 1 which does not carry the yarn or the yarn bundle 6 is limited, or even precluded, in the same manner as if the part of the means of transport 1 was carrying a yarn or yarn bundle 6.

As a consequence, the distribution of the flows of heat or of steam is homogenized over the whole of the yarn 6 part that is undergoing treatment on the means of transport 1 in the heat treatment device 5.

According to an embodiment feature of the management device of the invention, the means of sealing 2 is realized in the form of a fabric belt or of a yarn bundle. The choice of the means of sealing 2 is taken on the basis of the type of yarn or of yarn bundles 6 treated upstream and/or downstream of the means of sealing 2. Furthermore, on top of the width of the distribution of the placement of the yarn or of the yarn bundles 6 on the means of transport 1, that are to be considered to select the means of sealing 2, it is likewise important to consider the propensity of the treated yarn or yarn bundles 6 to be traversed by a flow of heat or of steam. Thus, the means of sealing 2 is selected on the basis of the sealing or to the contrary permeable nature of the treated yarn or yarn bundles 6 for the passage of a flow of heat or of steam in order to optimize the homogeneity of the distribution of the flows in the treatment device 5 of the yarns 6.

According to a construction feature, the heat distribution management device is characterized in that the length of the device is adapted to be at least equal to the cumulative length of the whole of the means 1 participating in the transport of yarns 6 in the treatment device 5 of the yarns 6. This construction feature allows for a device, according to the invention, of which the means of sealing 2 is sufficiently long to seal the whole of the means of transport 1 of yarns in the treatment device 5, before and/or after the treatment of the yarn or of the yarn bundle 6.

According to a construction feature that is complementary and/or alternative to the preceding construction feature, the heat distribution management device is characterized in that the length of the device is adapted to be at least equal to the length traveled by a yarn 6 in the treatment device 5 of the yarns 6. This construction feature allows for a device according to the invention the length of which is best adapted to the path followed by the yarn or yarn bundle 6 in the treatment device 5. Indeed, in particular when the yarn 6 is caused to be transferred from one means of transport 1 to another, it can occur that the length of the path followed by the yarn 6 is different from the cumulative length of the means of transport 1. Thus, when the yarn or yarn bundle 6 does not move over the whole of the length of the means of transport 1, the length of the path of the yarn 6 is shorter than that of the cumulative length of the means of transport 1. Conversely, when the yarn or yarn bundle 6 is transferred from one means of transport 1 to another by means of a drop between the two means of transport 1, the length of the fall increases the path of the yarn or yarn bundle 6 in relation to the distance of movement undertaken on the sole means of transport 1.

According to another construction feature of the device of the invention, the width of the device substantially corresponds to the width of the whole of the yarns 6 to be treated by the treatment device 5. In a complementary manner, the width of the device corresponds to the width of the spread of the yarn bundle 6 on the surface of the means of transport 1.

According to another construction feature of the device of the invention, the device comprises at least one fastener of the means of sealing 2 to one end of a yarn or of one yarn bundle 6. This fastener is preferably associated with the means of sealing 2 at its end. Thus, the fastener maintains the fastening of the yarn or yarn bundle 6 with the means of sealing 2 over the whole of the path of treatment in the heat treatment device. The risks of discontinuity between the yarn or yarn bundle 6 and the means of sealing 2 are reduced and the quality of the distribution of the heat and/or steam flows in the heat treatment device 5 is maintained.

The invention moreover relates to an implementation process of at least one heat distribution management device according to the invention, characterized in that the process comprises:

- a stage involving placement of the heat distribution management device on a means of transport 1 at the inlet opening of the treatment device 5 of the yarns 6,
- a stage involving distribution of the management device on at least one part of the width of the means of transport 1.

According to an implementation feature, the process according to the invention is characterized in that it comprises:

- a stage involving movement of the heat distribution management device on a means of transport 1 and a subsequent driving of a least one yarn 6 to be treated,
- a stage involving occupation by the heat distribution management device and at least one yarn 6 to be treated, of the length of the whole of the path of the yarn 6 to be treated on the means of transport 1 of the treatment device 5 of the yarns 6.

According to an alternative implementation feature, the process according to the invention is characterized in that it comprises:

- a stage involving movement of the heat distribution management device on a means of transport 1 being subsequently driven by at least one yarn 6 to be treated,
- a stage involving occupation by the heat distribution management device and at least one yarn 6 to be treated, of the length of the whole of the path of the yarn 6 to be treated on the means of transport 1 of the treatment device 5 of the yarns 6.

The invention furthermore relates to a mechanism for the recovery of a heat distribution management device according to the invention, characterized in that the recovery mechanism, which is able to be positioned at the outlet of the treatment device 5 of the yarns 6, comprises at least:

- one fastening interface to at least one end of the management device,
- one pivot axis 3 upon which the fastening interface is mounted,
- one device for coiling 4 around the pivot axis 3,
- one device for adjustment of the coiling speed on the basis of the speed of movement of at least one means of transport 1 of the treatment device 5 of the yarns 6.

According to a construction feature of the recovery mechanism, the fastening interface is arranged to interact with an end of the means of sealing 2 of the management device.

According to another construction feature of the mechanism, the adjustment of the coiling speed is carried out on the basis of the speed of movement of the last means of transport 1 which carries the management device of the invention.

Let it be clear that the invention is not limited to the embodiment described and represented in the appended drawings. Modifications remain possible, in particular, from the point of view of the make-up of the various elements or through substitution of equivalent techniques without however leaving the scope of protection of the invention.

What is claimed is:

1. A heat distribution management device in a yarn treatment device comprising:

(i) a transport device having orifices configured to be traversed by a flow of heat at the orifices; and (ii) at least one sealing device covering at least one part of the orifices of the transport device, said at least one sealing device being independent of the transport device.

2. The heat distribution management device of claim 1, wherein the at least one sealing device is a fabric belt or a yarn bundle.

3. The heat distribution management device of claim 1, wherein a length of the heat distribution management device is adapted to be at least equal to a length of the transport device.

4. The heat distribution management device of claim 1, wherein a length of the heat distribution management device is adapted to be at least equal to a length traveled by a yarn in the yarn treatment device.

5. The heat distribution management device of claim 1, wherein a width of the heat distribution management device corresponds to a width of all yarns to be treated by the yarn treatment device.

6. The heat distribution management device of claim 1, further comprising at least one fastener on the at least one sealing device configured to secure to one end of a yarn or a yarn bundle on the transport device.

7. A method for treating yarn with a treatment device, comprising:

a placement stage involving placement of the heat distribution management device according to claim 1 on the transport device at an inlet opening of the treatment device; and a distribution stage involving distribution of the heat distribution management device on at least one part of a width of the transport device.

8. The method of claim 7, further comprising:

a movement stage involving movement of the heat distribution management device on the transport device and subsequently driving a least one yarn to be treated; and an occupation stage involving occupation by the heat distribution management device and the at least one yarn to be treated, of a length of a path of the yarn to be treated on the transport device.

9. The method of claim 7, further comprising:

a movement stage involving movement of the heat distribution management device on the transport device as a result of movement of at least one yarn to be treated; and an occupation stage involving occupation by the heat distribution management device and the at least one yarn to be treated, of a length of a path of the at least one yarn to be treated on the transport device.

10. A yarn treatment system comprising:

a heat treatment device;

at least one transport device;

a heat distribution management device comprising a sealing device; and a recovery mechanism for the heat distribution management device positioned at an outlet of the heat treatment device, the recovery mechanism comprising:

a fastening interface mounted to at least one end of the heat distribution management device;

a pivot axis upon which the fastening interface is mounted;

a coiling device for coiling the sealing device of the heat distribution management device around the pivot axis; and an adjustment device for adjusting a coiling speed based on a speed of movement of the at least one transport device.

11. The heat distribution management device of claim 1, further comprising:

a recovery mechanism positioned at an outlet of the yarn treatment device, the recovery mechanism comprising:

a fastening interface mounted to at least one end of the heat distribution management device;

a pivot axis upon which the fastening interface is mounted;

a coiling device for coiling the at least one sealing device around the pivot axis; and an adjustment device for adjusting a coiling speed based on a speed of movement of the transport device.

12. A heat distribution management device in yarn treatment device comprising:

(i) a transport device having orifices configured to be traversed by a flow of heat at the orifices; and (ii) at least one sealing device covering at least one part of the orifices of the transport device, the at least one sealing device being independent of the transport device, wherein the at least one sealing device is a fabric belt or a yarn bundle and wherein the at least one sealing device is secured to an end of a yarn or a yarn bundle on the transport device.

13. The heat distribution management device of claim 12, further comprising:

a recovery mechanism positioned at an outlet of the yarn treatment device, the recovery mechanism comprising:

a fastening interface mounted to at least one end of the heat distribution management device;

a pivot axis upon which the fastening interface is mounted;

a coiling device for coiling the at least one sealing device around the pivot axis; and an adjustment device for adjusting a coiling speed based on a speed of movement of the transport device.

* * * * *